United States Patent [19]

Goka et al.

[11] Patent Number: 5,070,929

[45] Date of Patent: Dec. 10, 1991

[54] PATTERN FOR CASTINGS AND THE CASTINGS PRODUCED THEREFROM

[75] Inventors: Masahito Goka; Tadaomi Hirotsu, both of Fukuoka, Japan

[73] Assignee: Hitachi Metals, Ltd., Tokyo, Japan

[21] Appl. No.: 531,157

[22] Filed: May 31, 1990

[30] Foreign Application Priority Data

Jun. 6, 1989 [JP] Japan ..... 1-66071[U]

[51] Int. Cl.[5] ..... B22C 7/00

[52] U.S. Cl. ..... 164/235; 164/45

[58] Field of Search ..... 164/235, 241, 242, 243, 164/45, 44

[56] References Cited

U.S. PATENT DOCUMENTS 4,719,958 1/1988 Schopp et al. ..... 164/243

FOREIGN PATENT DOCUMENTS 3316120 11/1984 Fed. Rep. of Germany ..... 164/241

53-50728 12/1978 Japan .

57-156861 9/1982 Japan ..... 164/44

*Primary Examiner*—Kuang Y. Lin

*Attorney, Agent, or Firm*—Finnegan, Henderson, Farabow, Garrett and Dunner

[57] ABSTRACT

The present invention relates to a pattern for castings and the castings produced from the pattern. The pattern comprises a pattern plate including a parting plane, at least one multistage draft and at least one substantial draft extending from the parting plane. A casting having a suitable draft includes corner portions formed by the parting plane.

9 Claims, 3 Drawing Sheets

PATTERN FOR CASTINGS AND THE CASTINGS PRODUCED THEREFROM

BACKGROUND OF THE INVENTION

1. Field of the Invention

The present invention relates to a pattern for castings and castings produced by the pattern of the invention, and more particularly to a pattern for castings which is provided with a suitable multistage draft that improves clamping performance and pattern drawing performance at corner portions of the parting plane of the pattern to reduce the chance of mold drop.

2. Description of the Prior Art

FIG. 5 shows a conventional pattern for castings. The pattern is provided with a single draft having an angle 8' of generally 1–3 degrees for a smooth pattern draw. A corner portion 9' at a parting plane of the pattern 1' is also provided with a chamfer R of a suitable size (conventionally 1–3 mm) to avoid improper mold clamping as well as mold drop when drawing the pattern. Mold drop occurs in the case that an unexpected force is transmitted to the corner portion 9, at the parting plane 5' when the pattern is not drawn perpendicularly to the pattern plane.

The provision of the chamfer R considerably improves the mold clamping performance at the corner portion 9' but causes sharp and peaked acute casting fins 6 at the tip end of the casting as shown in FIG. 7. There is a possibility of workers hurting their hands on the acute casting fins 6. Also, the casting fins 6 may be caught by transferring devices as well as jigs and tools in subsequent machining and assembly operations causing various troubles. In order to avoid these problems the casting fins must first be removed before the subsequent processes can take place, which requires a considerable amount of finishing time and cost. Furthermore, chamfers R are absolutely unnecessary from the point of view of the physical dimensions of the final product.

As shown in FIG. 6, some patterns are made with edges having a substantially right angle at the corner portion 9' rather than the chamfer R. However in these cases, the clamping performance is by no means adequate at these corner portions, thereby causing mold drop when drawing the pattern, as well as causing casting fins which must be removed as described above.

As illustrated in FIG. 4, Japanese Utility Model Publication No. 53-50728 discloses a pattern for pipe joints or valves which is provided with a draft in the form of tangent lines 10 intercepting the parting plane 5, drawn from the outer surface of a circular body of the pipe. By this arrangement, the draft in the vicinity of the parting plane 5 is not strictly vertical, which not only avoids the mold drop at the corner portion 9 but also ensures improved mold clamping performance at the corner portion 9. This arrangement may be applied to the castings such as the pipe joints and valves in which the height of the casting is not large, but may not be applied to conventional castings that are vertical (at right angle to the parting plane) and relatively tall in height.

SUMMARY OF THE INVENTION

An object of the present invention is to provide a casting pattern in which proper setting of the shapes, dimensions, and draft of the pattern provides less possibility of causing acute casting fins, as well as improving the strength of the corner portions of conventional vertical and relatively tall castings.

Another object of the invention is characterized by a pattern for castings having a suitable draft which is provided with at least one multistage draft in the vicinity of the corner portions of the parting plane. The term multistage draft refers to a substantial draft and at least one additional stage draft, proceeding toward the parting plane.

To achieve the objects and in accordance with the purpose of this invention, as embodied and broadly described herein, the invention comprises a pattern for castings having a suitable draft. The pattern comprises a pattern plate in communication with the pattern. The pattern plate has a parting plane and the pattern includes at least one additional draft extending toward the parting plate and connecting to the substantial draft.

The invention further comprises a casting having a suitable draft. The casting comprises corner portions that are formed by a parting plane of a pattern for making the casting and by at least one multistage draft in the vicinity of the corner portions.

It is to be understood that both the foregoing general description and the following detailed description are exemplary and explanatory only and are not restrictive of the invention, as claimed.

The accompanying drawings, which are incorporated in and constitute a part of this specification, illustrate the embodiments of the invention and together with the description, serve to explain the details, features and advantages of the invention.

DETAILED DESCRIPTION

Reference will now be made in detail to the present preferred embodiments of the invention, examples of which are illustrated in the accompanying drawings. Wherever possible, the same reference number will be used throughout the drawings to refer to the same or like parts.

Figure 1:
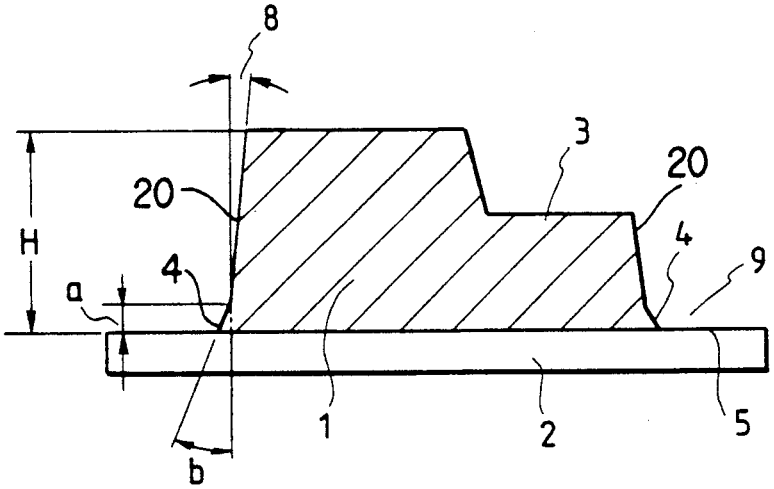
FIG. 1 is a cross-sectional view of a male pattern for castings according to the present invention.

As shown in FIG. 1, a break point of the final stage 4 of the multistage draft starts for example 2–10 mm from the parting plane 5 and pattern plate 2. The height a of the final stage draft 4 is divided by the height H, which is the maximum extent that the substantial draft 20 (having a draft angle 8) rises from the parting plane 5. The ratio a/H, represented in percentage, is selected to be from 1–50%, while the angle b of the final stage draft 4 is selected to be between 2–10 degrees. This is because a final stage draft 4 that begins less than 2 mm from the parting plane 5 as well as having a value of a/H less than 1% is not effective in improving the mold clamping performance. Moreover, a breakpoint of the final stage draft 4 that rises more than 10 mm as well as a value a/H of more than 50% causes too large a draft, which in turn causes deviations from the desired casting dimensions. Another reason why the angles b of the final stage draft 4 should be between 2–10 degrees, is that angles less than 2 degrees are not effedtive in mold clamping while angles larger than 10 degrees cause deviations from the desired dimension.

A second aspect of the invention is characterized by castings produced through the use of the above pattern. The castings have a suitable draft and are provided with at least one additional stage draft in the vicinity of the corner portion of the parting plane.

Figure 7:
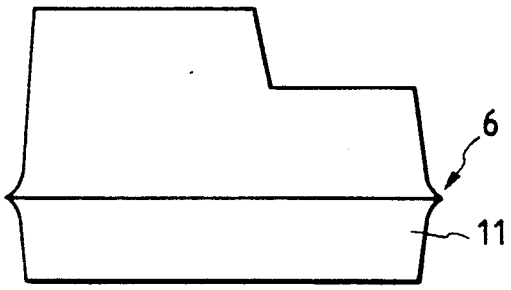
FIG. 7 PRIOR ART
FIG. 7 is a side view illustrating casting fins produced by the castings of the prior art.
Figure 8:
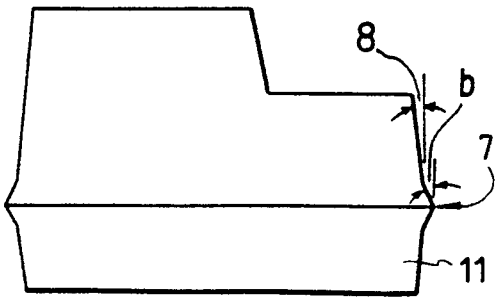
FIG. 8 is a side view of a casting illustrating casting fins according to the present invention .

The present invention is arranged as described above, thus the mold clamping performance at the corner portion is greatly improved without the chamfer R as compared to the conventional pattern, and is equal to or better than the one with a chamfer radius of 1–3 mm. Another advantage of the present invention is that the casting fins of casting 11 resulting from the practice of the present invention are rather obtuse projections 7 as shown in FIG. 8. This contrasts with the sharp and acute casting fins 6 that result from the conventional chamfer radius of 1–3 mm as shown in FIG. 7. The projections produced by the present invention protrude more than those for castings with no chamfer, but have no casting fins with acute tip ends as do castings having a chamfer. Thus, no substantial fin removing operation at is required before completing the castings.

Figure 2:
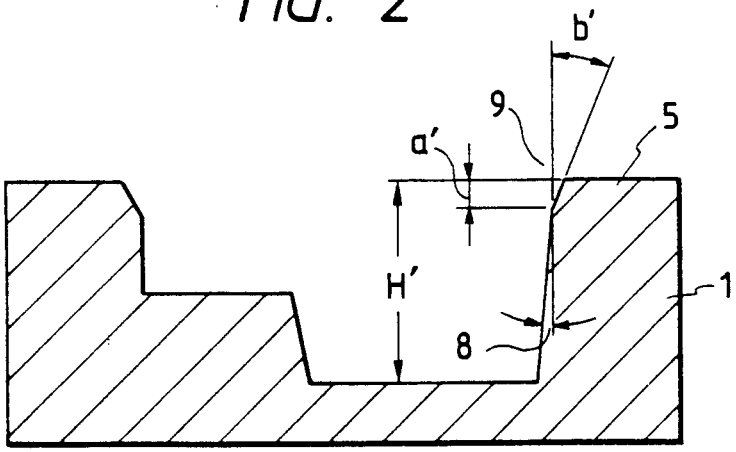
FIG. 2 is a mold made by the male pattern for castings according to the present invention.

As shown in FIG. 2, in the female casting pattern 1 the heights a' and H' extend below the parting plane and are selected to have the same range of values as the male casting pattern of FIG. 1. The angle b, can have the same range of values as the angle b discussed above.

Figure 3:
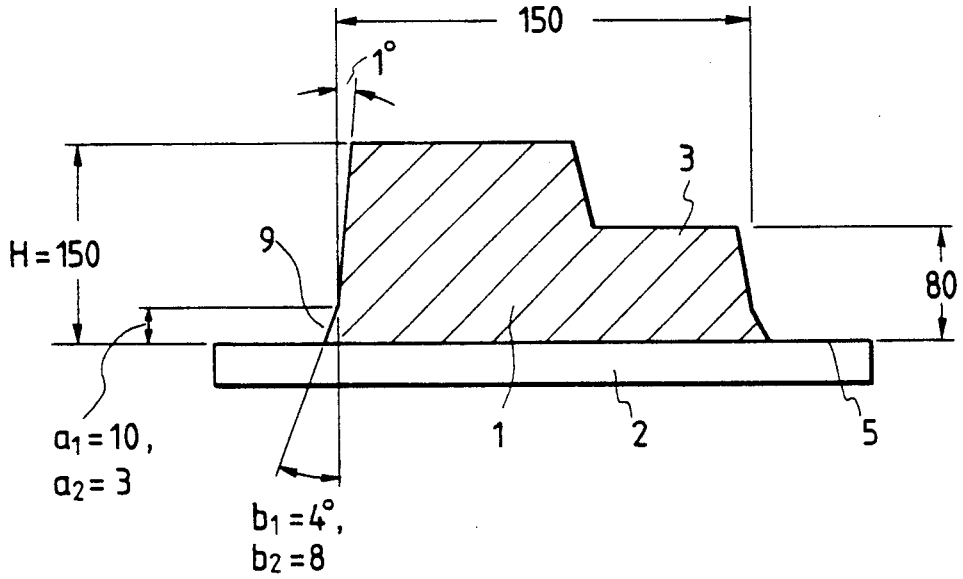
FIG. 3 is an illustration showing dimensions of the pattern for castings used in the embodiments of the invention.
Figure 4:
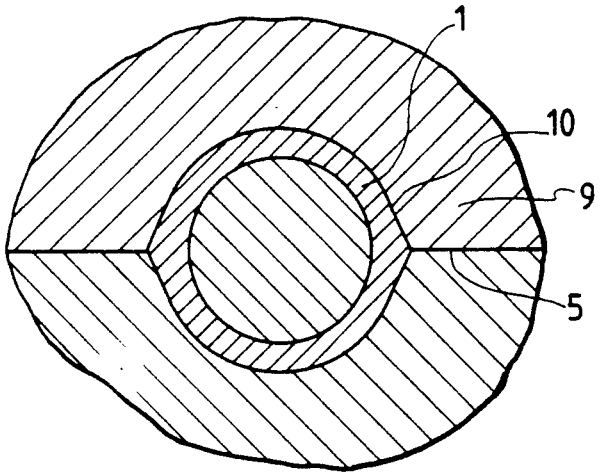
FIG. 4 is a cross-sectional view of the pattern for tube joints and valves to which a tangent draft is applied.

In one embodiment of the invention, a basic pattern 1 has a width of 100 mm, a length of 150 mm, a maximum height H of 150 mm, a height of the flat land 3 of 80 mm, and a draft angle 8 of 1 degree as shown in FIG. 3. Then, a pattern #1 was made to have at the corner portion 9 of the parting plane 5 thereof an angle b1 of four degrees at a height al of 10 mm from the parting plane 5. Still another pattern #2 was made to have an angle b2 of eight degrees at a height a2 of 3 mm from the parting plane 5, also shown in FIG. 3.

Figure 5:
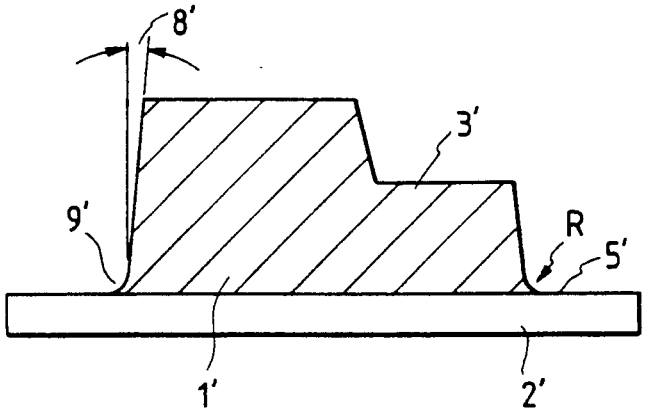
FIG. 5 PRIOR ART
FIG. 5 is a cross-sectional view of a conventional pattern for castings having a chamfer R at the corner portion thereof.
Figure 6:
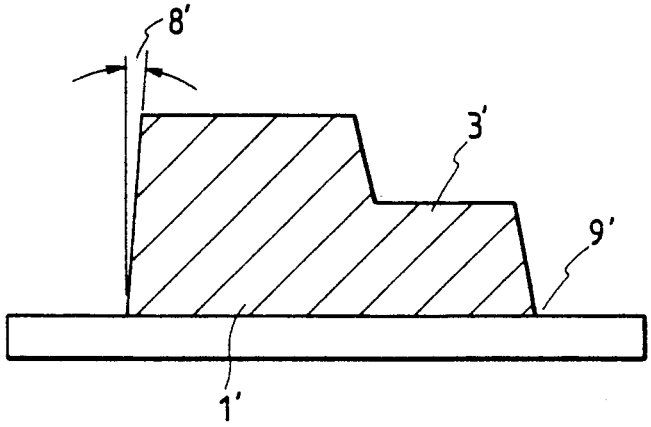
FIG. 6 PRIOR ART
FIG. 6 is a cross-sectional view of a conventional pattern for castings without a chamfer.

Several patterns for comparison purposes were made: a pattern #3 having no chamfer R as shown in FIG. 6, a pattern #4 having a chamfer R of 1 mm as shown in FIG. 5, a pattern #5 having a chamfer R of 2 mm, and a pattern #6 having a chamfer R of 3 mm.

Twenty moldings were made for each of these six patterns using the same casting sand and were poured to evaluate:

(a) the mold drop of the corner portions of the drawing pattern and (b) the average length of casting fins of the castings. Table 1 shows the results.

TABLE 1

| | (mm) | | | mold | length of the | removal of |
|---|---|---|---|---|---|---|
| | a | b | R | drop | casting fin | casting fins |
| #1 | 10 | 4° | — | 1 | 0.7 | Not required |
| #2 | 3 | 8° | | 2 | 0.5 | Not required |
| #3 | — | — | 0 | 12 | 1.5 | required |
| #4 | — | — | 1 | 6 | 1.3 | required |
| #5 | — | — | 2 | 2 | 1.9 | required |

TABLE 1-continued

| | (mm) | | | mold | length of the | removal of |
|---|---|---|---|---|---|---|
| | a | b | R | drop | casting fin | casting fins |
| #6 | — | — | 3 | 1 | 2.5 | required |

The entire circumference of each of the castings was measured and the measurements averaged out for the twenty castings, including those that resulted in mold drop.

As is apparent from the above description, the use of the pattern for castings according to the present invention makes it possible to ensure mold clamping performance at the corner portions thereof, the mold clamping performance being as good as or even better than those of chamfered corner portions.

Also, the castings through the use of the pattern of the present invention have no acute casting fins at their tip ends such as the acute casting fins formed by the conventional castings, but have gradually varying contours, eliminating the need of removing casting fins. Thus, the present invention makes it possible to improve the efficiency in molding and to greatly reduce the subsequent removing processes which would otherwise be required.

What is claimed is:

1. A pattern for castings having a suitable draft comprising:

a pattern plate, said pattern plate having a parting plane; and a portion of said pattern having at least one multistage draft extending toward said parting plane, said multistage draft including at least a first substantial draft and a second draft, wherein said second draft rising from said first draft.

2. The pattern for castings of claim 1, wherein said at least one multistage draft includes a final stage having a height a from said parting plane and said height a is between 2 and 10 millimeters.

3. The pattern castings of claim 2, wherein said at least one substantial draft has a maximum extent of H from said parting plane, and wherein said height a is between 1% and 50% of H.

4. The pattern for castings of claim 1, wherein said final stage forms an angle b with a line perpendicular to said parting plane.

5. The pattern for castings of claim 4, wherein said angle b of said final stage is between 2 and 10 degrees.

6. A pattern comprising:

a pattern plate, the pattern plate having a parting plane;

a first draft adjacent to the parting plane, the first draft rising at a first predetermined angle with respect to a line normal to the parting plane; and a second draft rising from the first draft, the second draft rising at a second predetermined angle with respect to a line normal to the parting plane, wherein the second predetermined angle is less than the first predetermined angle.

7. The pattern as claimed in claim 6 wherein the first draft rises to a height of 2 to 10 millimeters above the parting plane.

8. The pattern as claimed in claim 6 wherein the first draft rises to a first predetermined height $h_1$ above the parting plane and the second draft rises to a second predetermined maximum height $h_2$ above the first draft, and wherein $$0.01 < h_1/(h_1+h_2) < 0.5$$

9. The pattern as claimed in claim 6 wherein the first predetermined angle is from 2 to 10 degrees.

* * * * *